US005133140A

United States Patent [19]

Frey

[11] Patent Number: 5,133,140

[45] Date of Patent: Jul. 28, 1992

[54] FRAME WITH FABRIC SECURING TOOTHED STRIPS OR MOLDINGS AND METHOD

[75] Inventor: Joseph M. Frey, Sun Prairie, Wis.

[73] Assignee: Uniek Plastics, Inc., Waunakee, Wis.

[21] Appl. No.: 603,883

[22] Filed: Oct. 24, 1990

[51] Int. Cl.[5] ..... D06C 3/08; A47G 5/00

[52] U.S. Cl. ..... 38/102.91; 38/102.1; 160/398

[58] Field of Search ..... 38/102, 102.1, 102.3, 38/102.91; 160/374.1, 368.1, 369, 378, 382, 398, 403, 404; 101/127.1

[56] References Cited

U.S. PATENT DOCUMENTS

| | | | |
|---|---|---|---|
| 1,895,309 | 1/1933 | Boomershine | 38/102.91 |
| 2,429,256 | 10/1947 | Block | 38/102.91 |
| 2,456,225 | 12/1948 | Thomas | 38/102.91 |
| 2,957,269 | 10/1960 | Nohl et al. | 38/102.2 |
| 3,830,278 | 8/1974 | Packer | 38/102.91 X |
| 3,841,008 | 10/1974 | Cusick | 38/102.91 |
| 3,885,333 | 5/1975 | Zachary | 38/102.2 |
| 3,922,804 | 12/1975 | Batey | 38/102.91 |
| 3,950,869 | 4/1976 | Samarin | 38/102.91 |
| 4,097,968 | 7/1978 | Pikus | 38/102.91 X |
| 4,151,665 | 5/1979 | Gibby | 38/102.91 |
| 4,637,147 | 1/1987 | Wolsey | 38/102.1 |
| 5,033,529 | 7/1991 | Koschade | 38/102.91 |

FOREIGN PATENT DOCUMENTS

| | | | |
|---|---|---|---|
| 0646306 | 2/1989 | Japan | 38/102.2 |
| 0799161 | 8/1958 | United Kingdom | 38/102.2 |

*Primary Examiner*—Werner H. Schroeder
*Assistant Examiner*—Ismael Izaguirre
*Attorney, Agent, or Firm*—Quarles & Brady

[57] ABSTRACT

A device and method for mounting fabric on a mounting board or frame. The device includes a channel molding or strip having a plurality of barbs of cone shaped teeth located on the outside surface of the channel. The device is fitted on the edge of a mounting board or frame, fabric is stretched over the board or frame and impaled on the barbs or teeth thus securing the fabric on the mounting board or frame. The device is small enough that it would be hidden within the rabbet of conventional picture frame molding.

15 Claims, 6 Drawing Sheets

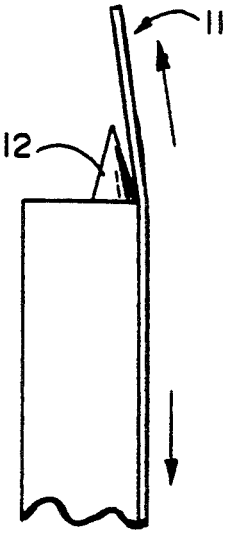
FIG. 11A
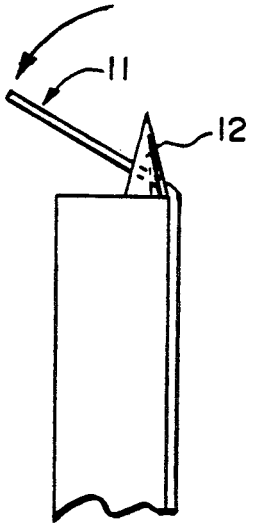
FIG. 11B
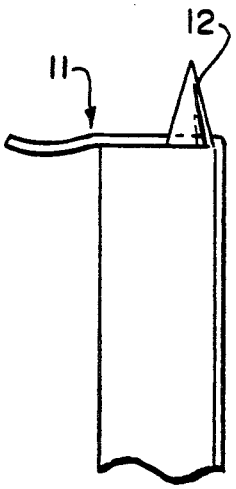
FIG. 11C
FIG. 12
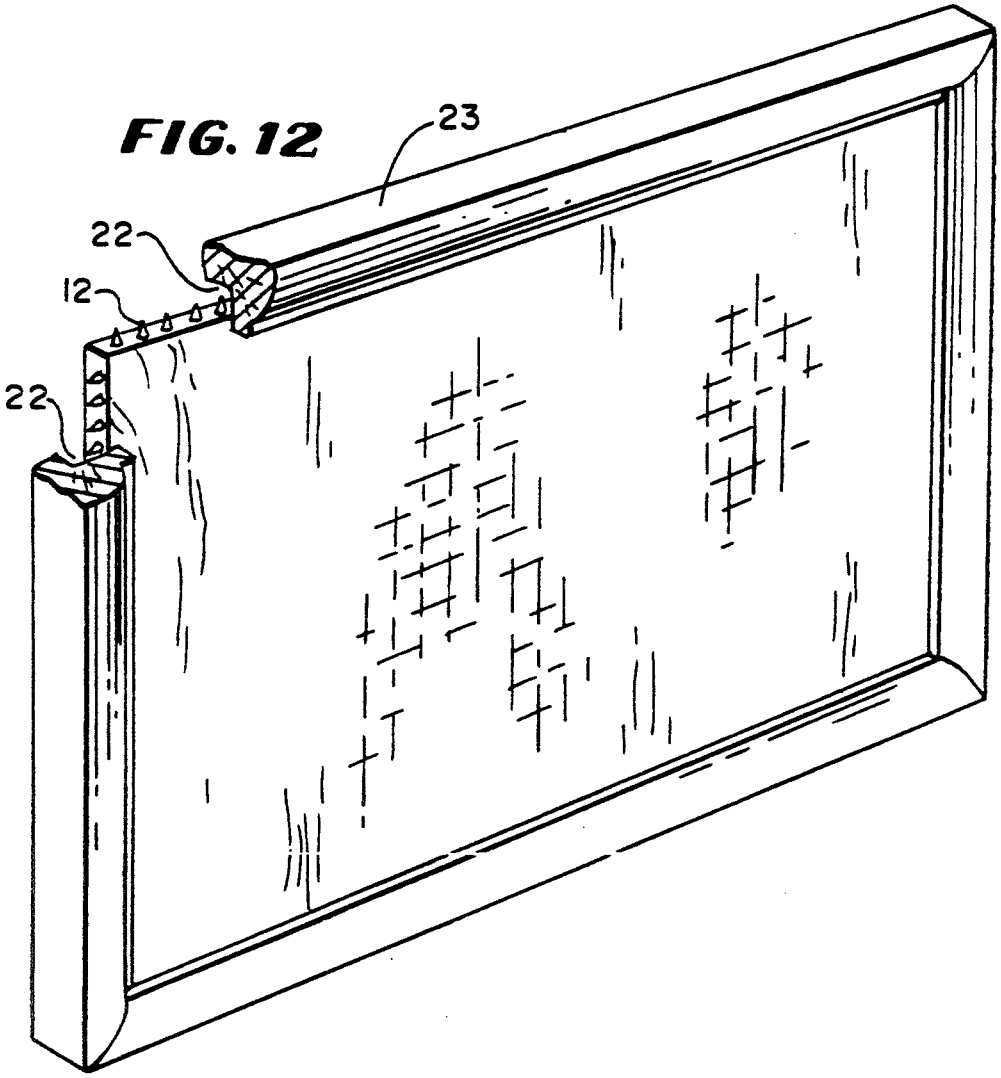

FRAME WITH FABRIC SECURING TOOTHED STRIPS OR MOLDINGS AND METHOD

BACKGROUND OF THE INVENTION

1. Field of the Invention

The present invention is related to the field of apparatus and methods for mounting fabric on a mounting board or stretcher bar frame.

2. Description of the Related Art

Needle work and fabric art are often mounted on a mounting board and framed for display. This is generally accomplished by stretching the fabric over the board and securing it by lacing the fabric over the mounting board with needle and thread, stapling or pinning the fabric to the board, gluing the fabric to the mounting board with various types of glue, or adhering the fabric with double sided tape around the perimeter of the mounting board.

All of the above mentioned methods for mounting fabric to a board can be used successfully. However, each method requires a certain degree of skill and considerable time of the person doing the mounting. Further, accurate alignment and repositioning of the fabric on the mounting board with each of the above methods is very difficult.

What is needed is an apparatus and method which allows one to mount fabric on a mounting board without requiring a great deal of skill or time and which permits accurate alignment and repositioning of the fabric on the board to be easily obtained. These requirements are addressed by the present invention.

SUMMARY OF THE INVENTION

The present invention pertains to a device and method for mounting fabric to a mounting board or stretcher bar frame. In its preferred embodiment, the device comprises a channel molding which has a front, back and side wall so as to generally form a channel. Located on the outside surface of the side wall is a plurality of barbs or teeth. The present invention is formed of a resilient material and is of a size sufficient to fit snugly about the edge of the mounting board and yet be hidden by the rabbet of a conventional picture frame. The barbed channel molding also has a measuring scale incorporated into its design for easy cutting and is small enough to fit inside the rabbet of the picture frame molding.

In use, the barbed channel molding is fitted on the edge of a mounting board. Fabric is stretched over the board and impaled on the barbs or teeth thus securing the fabric on the mounting board. The fabric can then be trimmed and framed in a conventional manner. The barbed channel molding is small enough to fit within the rabbet of the picture frame and is thus hidden from view.

An alternative embodiment of the device of the invention includes an L-shaped barbed molding having only a back and side wall with the barbs or teeth carried on the side wall. A further alternative is a barbed side wall having no back or front wall. These embodiments have the advantage of permitting the barbs to be mounted on either the side edge of the mounting board or the front or back edge of the mounting board. Since these embodiments do not have a channel for securing the barbs to the mounting board, they would have to be attached with either an adhesive or a stapling means.

The novel features which are believed to be characteristic of the invention both as to its organization and method of operation, together with further objectives and advantages thereof, will be better understood from the following drawings in which a presently preferred embodiment of the invention is illustrated by way of example. It is to be expressly understood, however, that the drawings are for the purpose of illustration and description only and are not intended as definitions of the limits of the invention.

BRIEF DESCRIPTION OF THE DRAWINGS

FIGS. 11A–11C are side views of stretching fabric over the device of the invention.

FIG. 12 is a perspective view with cut-away to show a picture frame molding fitting over the device of the invention.

DESCRIPTION OF THE PREFERRED EMBODIMENTS

An understanding of the present invention can be readily gained by reference to the drawings. The invention is of a device and method for use in mounting fabric to a mounting board or stretcher bar frame. A plurality of teeth or barbs is attached to the periphery of the mounting board or stretcher bar frame. Fabric is then stretched over the board or frame and impaled on the teeth or barbs. Once impaled by the teeth or barbs the fabric is gripped or held taut for working with or for display. A mounting board as understood in the art is commonly a dense foam board having a thickness of approximately an eighth to a quarter inch. A stretcher bar frame is generally an interlocking wood frame over which fabric can be stretched and secured.

The preferred embodiment of the invention is a plurality of cone-shaped teeth carried on the outside face of a molding manufactured from a resilient material such as plastic or light metal.

Figure 1:
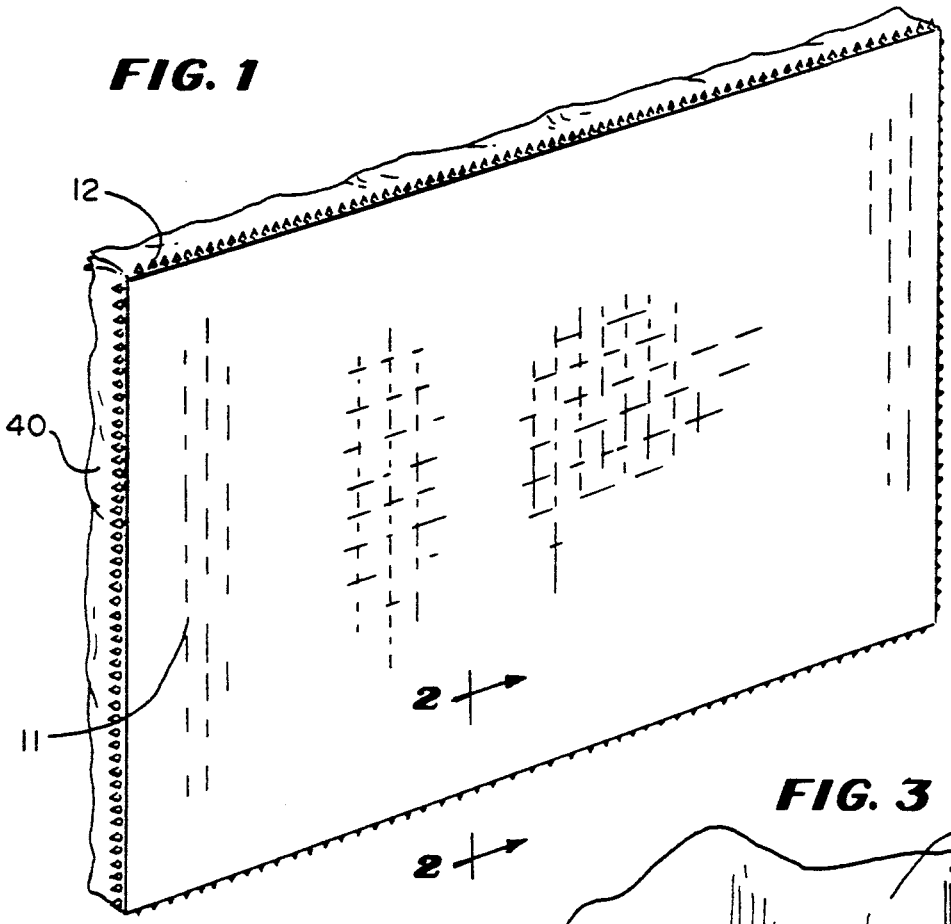
FIG. 1 is a perspective view of fabric mounted on a mounting board using the device of the invention.
Figure 2:
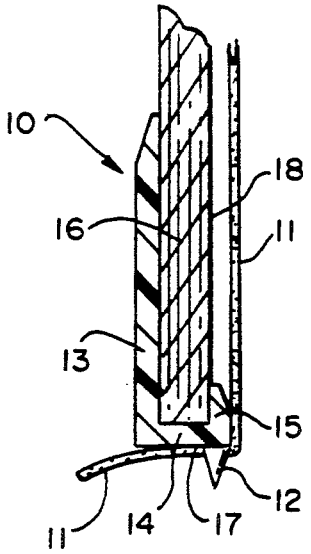
FIG. 2 is a cross section of FIG. 1 through 2—2.
Figure 15:
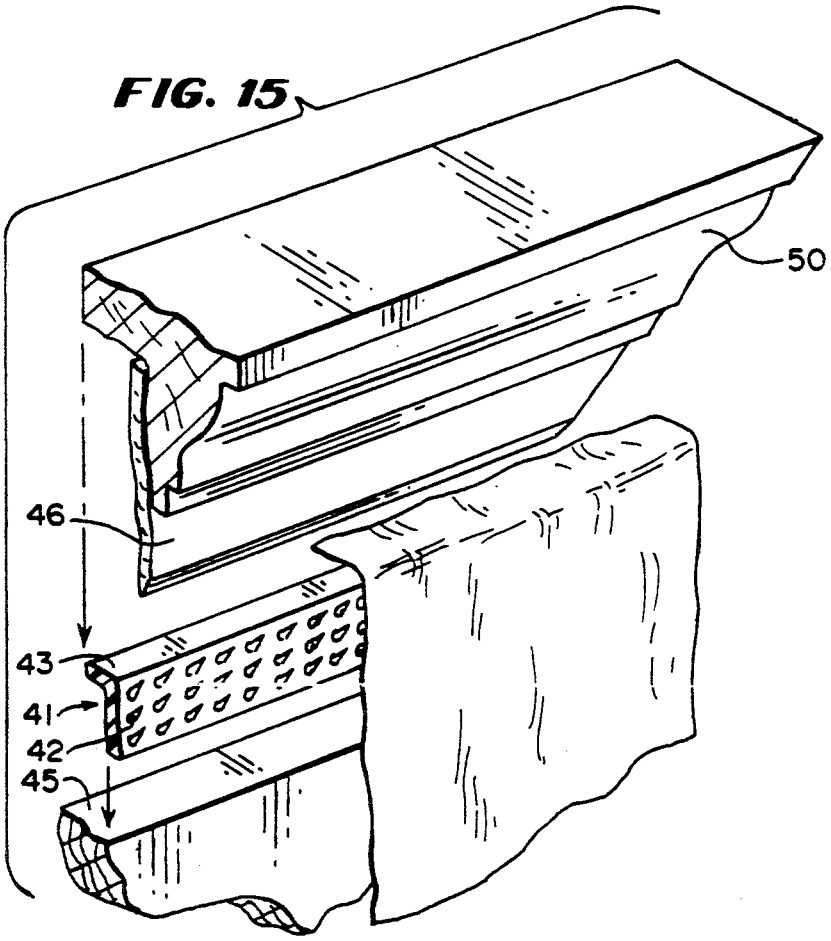

Turning now to the drawings, FIG. 1 illustrates a fabric 11 stretched and mounted on a mounting board using the device and method of the present invention. As can be seen, the fabric is secured by the means for gripping fabric which in the preferred embodiment is a row of cone-shaped teeth 12 carried on a portion of the outside face of a channel molding. FIG. 2 is a cross section of FIG. 1 at 2—2 and illustrates the rear wall 13, side wall 14 and front wall 15 of the molding. In the preferred embodiment, the channel is of sufficient size so as to fit snugly about the edge of a mounting board 16. On the outside surface 17 of the side wall, Opposite the front wall 15 is carried a means for gripping a fabric. In the preferred embodiment of the invention, this means for gripping a fabric is a plurality of cone-shaped teeth 12 attached to a frame or mounting board so as to be generally perpendicular to the surface of the side edge 40 of the frame or mounting board. Such teeth have the characteristic of gripping the fabric without tearing or otherwise damaging the fabric. Although the preferred embodiment uses cone-shaped teeth, other means for gripping may also be used and would be considered to fall within the scope of the invention. For example, barbs or spines such as illustrated in FIG. 15, element 42, could be used. One should take care, however, in selecting a shape that does not have a tendency to damage the fabric and make repositioning of the fabric more difficult. In place of teeth or barbs, adhesives of various kinds may also be used and fall within the scope of the invention.

Figure 3:
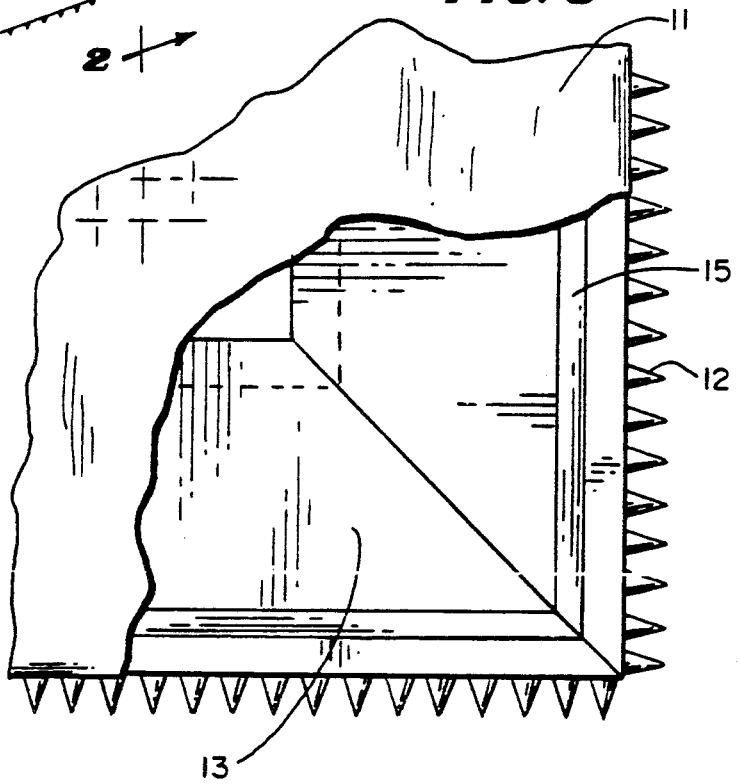
FIG. 3 is a partial view of the device of the invention fitted on the edge of a mounting board.

FIG. 3 is a partial view of the corner of two joined sections of the device of the invention with the fabric 11 and mounting board cut away to reveal the channel molding of the invention fitted on the edge of the frame. In the view of FIG. 3 can be seen the front wall 15, the rear wall 13 and the cone-shaped teeth 12.

Figure 4:
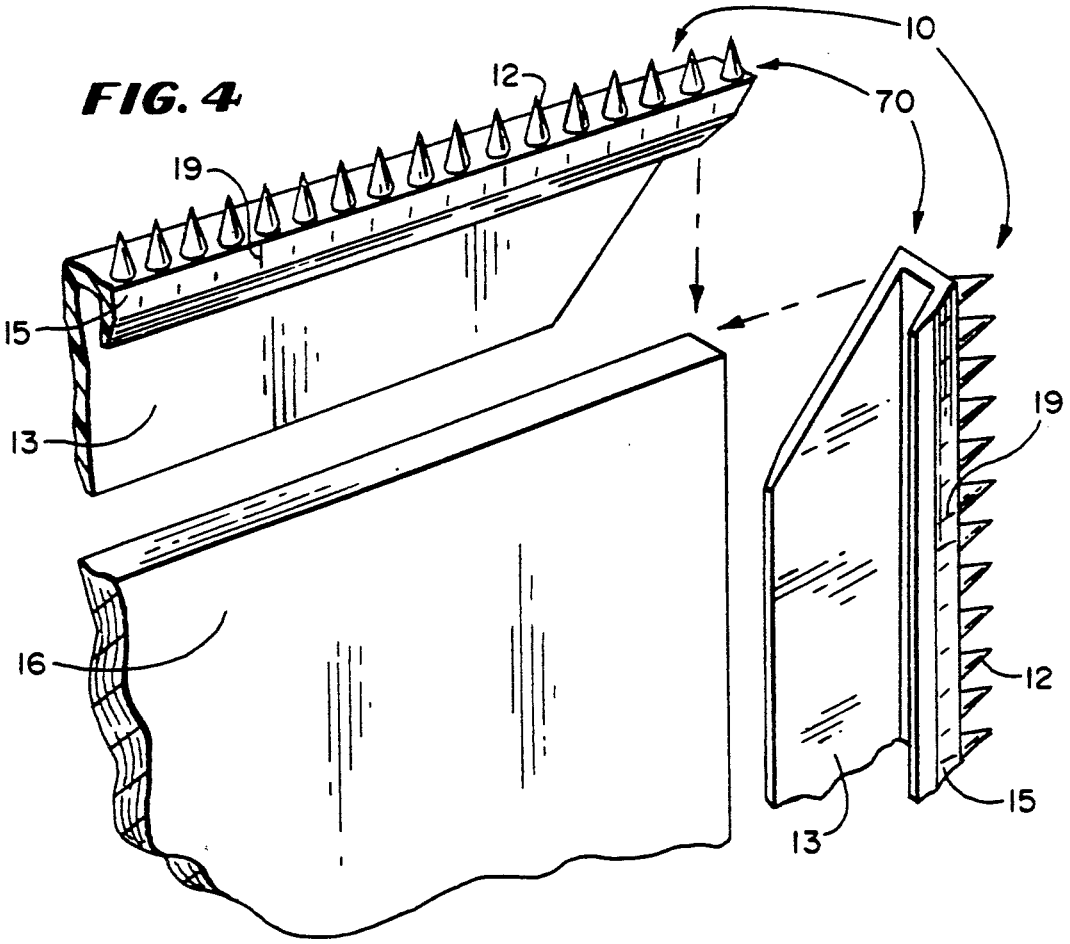
FIG. 4 illustrates how the device of the invention is fitted onto the edge of a mounting board.
Figure 5:
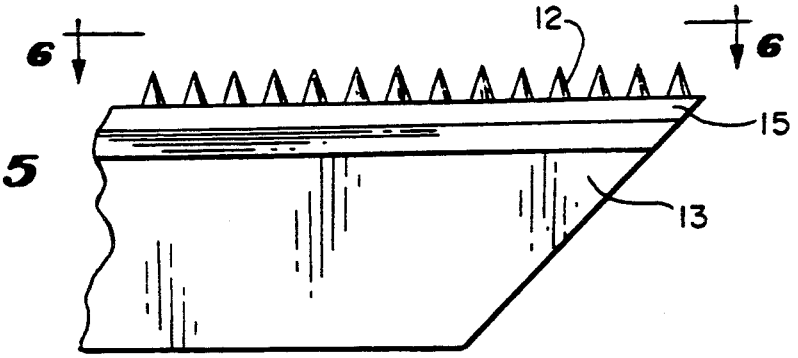
FIG. 5 is a plan view of the device of the invention.
Figure 6:
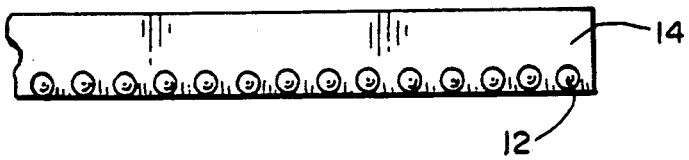
FIG. 6 is a view of the device of FIG. 5 from the vantage point of 6—6.

FIG. 4 is a partial exploded view of the channel molding illustrating more completely how the channel molding 10 fits about the edge of a mounting board 16. Note that the ends 70 of the channel molding are mitered so as to fit the molding about the corner of the mounting board. Also illustrated in FIG. 4 is the incorporation of a measuring scale 19 to facilitate easy measurement for cutting of the molding. FIG. 6, is a view of the side wall which illustrates that in the preferred embodiment, the teeth 12 are positioned along the one edge of the side wall 14 opposite the front wall 15. This position for the teeth 12 and the thickness of the front wall 15 help to hold the stretched fabric 11 slightly above the surface 18 of the mounting board 16 (See, FIG. 2) so that the knots of the needlepoint do not cause unsightly bulges in the stretched fabric.

Figure 7:
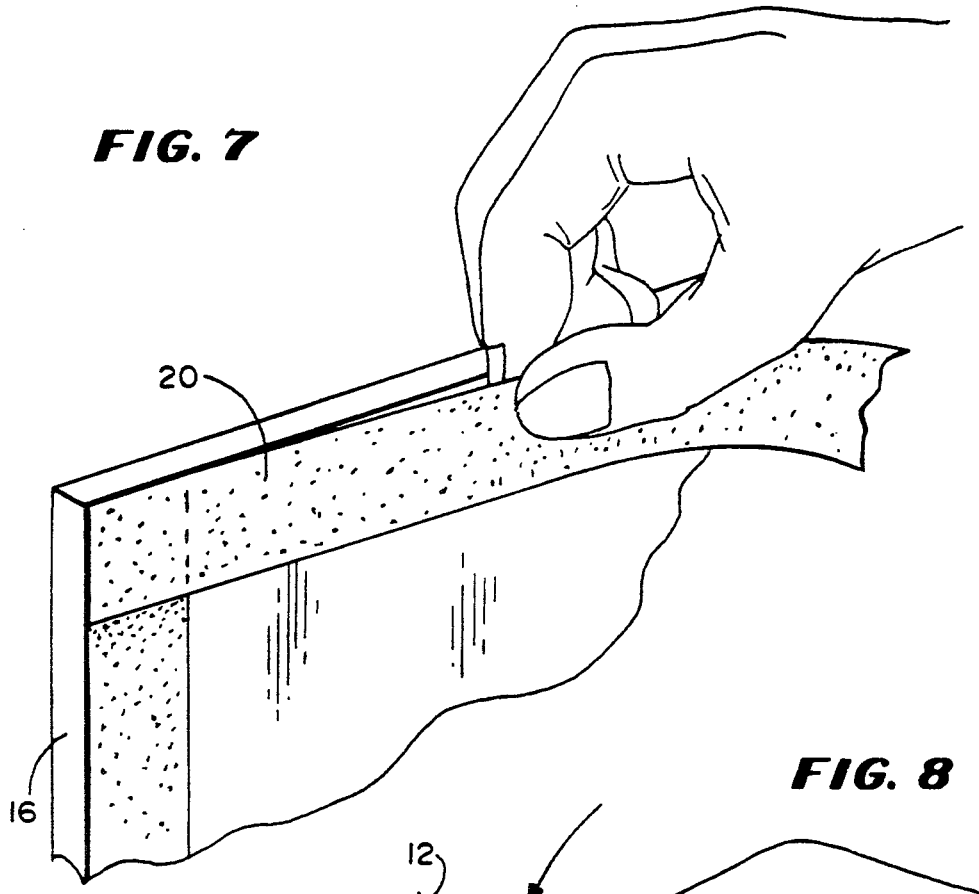
FIG. 7 illustrates the application of double sided tape to the periphery of the backside of a mounting board.

FIG. 7 illustrates that in the preferred embodiment, double sided tape 20 is applied at the back periphery of the mounting board 16. In the preferred embodiment the rear wall 13 of the channel molding is wider than the front wall 15 (see FIGS. 2 and 4). This permits greater surface area for adhesion to the double sided tape 20. The narrower front wall 15 helps to securely fit the channel on the edge of the mounting board but is also easily hidden from sight when the fabric is framed with a conventional picture frame.

FIGS. 9, 10 and 11A–C illustrate fitting the channel molding 10 about the edge of a mounting board 16, stretching the fabric 11 over the surface of the board (see FIGS. 10 and 11A), catching or gripping the fabric with the cone-shaped teeth 12 (see FIGS. 10 and 11B) and securing the stretched fabric 11 with the cone-shaped teeth 12. In actual use with the channel molding of the invention, if the fabric is misaligned or out of position, the fabric may be easily repositioned by lifting the fabric (FIGS. 11A–C in reverse), repositioning it and re-securing it with the cone-shaped teeth.

FIG. 12 illustrates a fabric stretched and mounted on a mounting board being framed with a conventional picture frame 23. As can be seen in FIG. 12, the small size of the channel molding and the cone-shaped teeth permit hiding of the teeth 12 in the rabbet 22 of a conventional frame.

Figure 8:
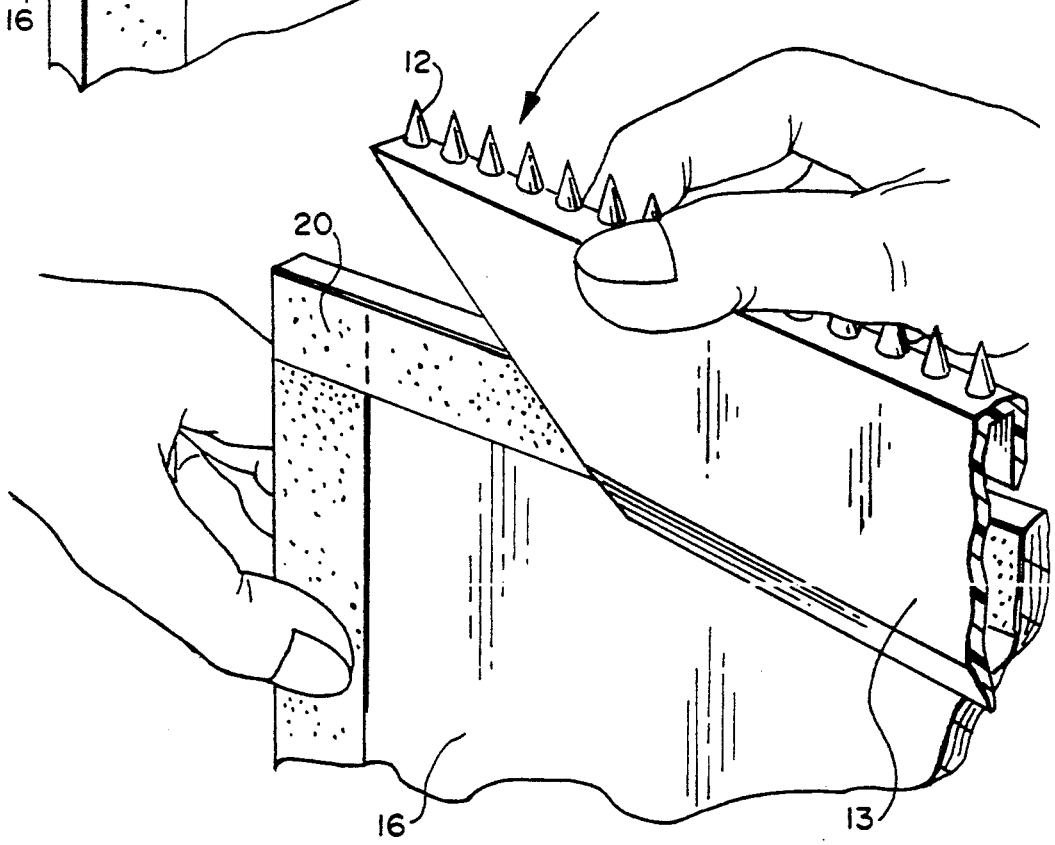
FIG. 8 illustrates a back partial perspective of fitting the device of the invention onto the double sided tape of FIG. 7.
Figure 9:
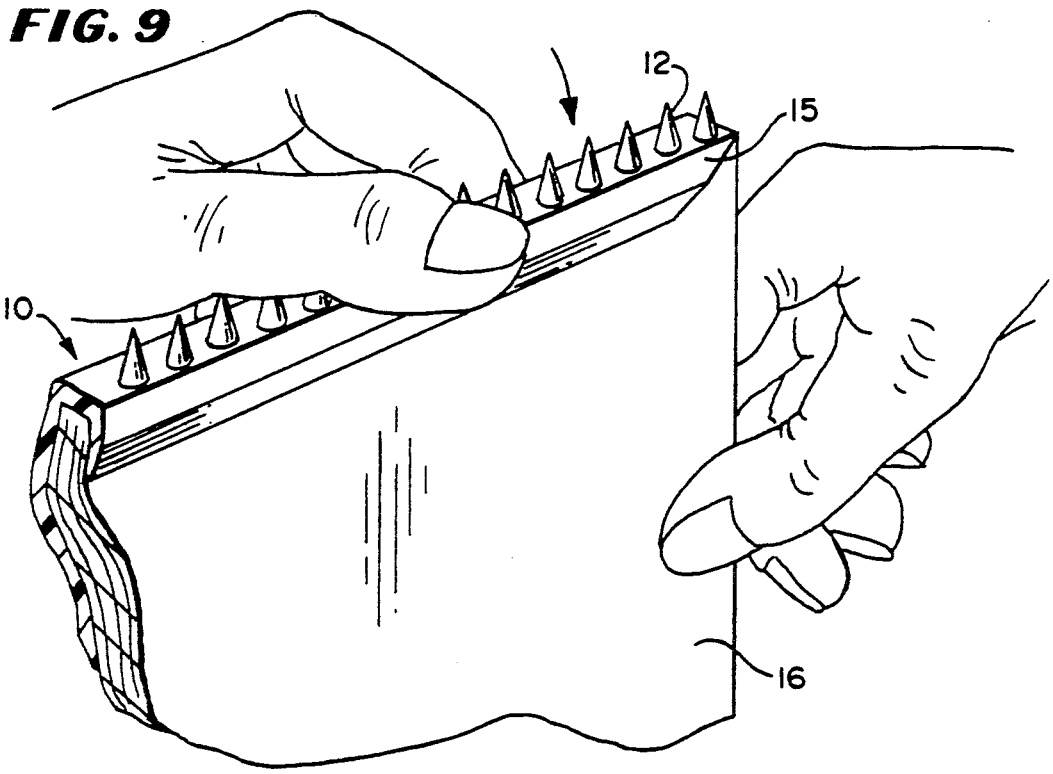
FIG. 9 illustrates a front partial perspective of fitting the device of the invention onto the edge of a mounting board.
Figure 10:
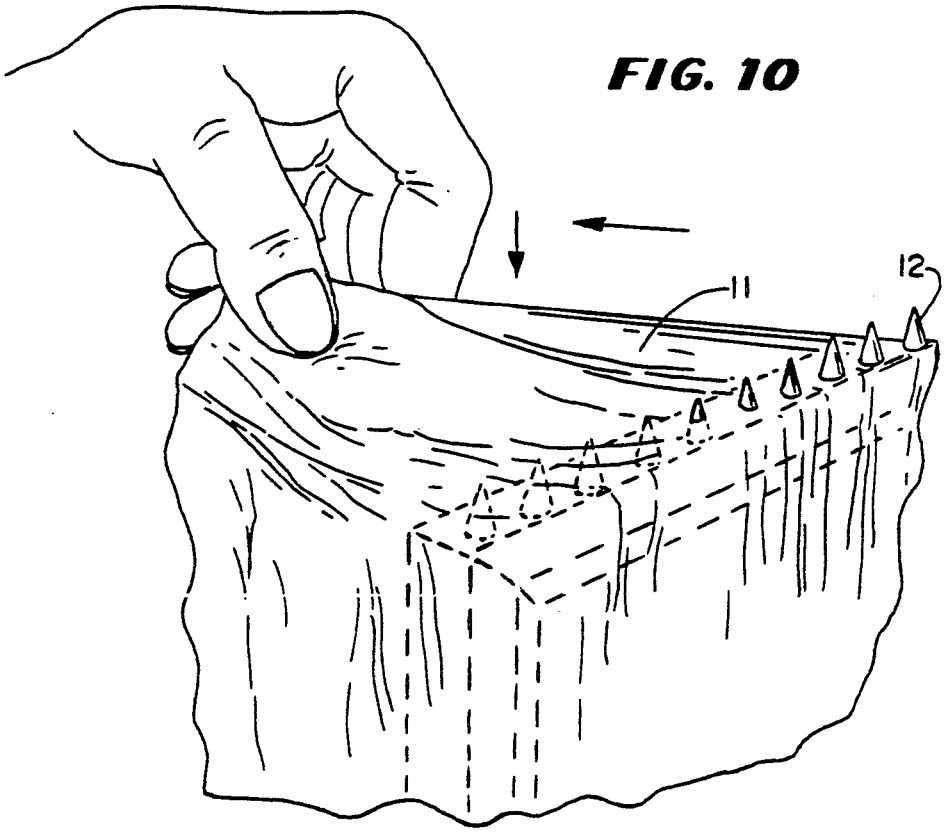
FIG. 10 illustrates a front partial perspective of stretching fabric over the device of the invention.
Figure 13:
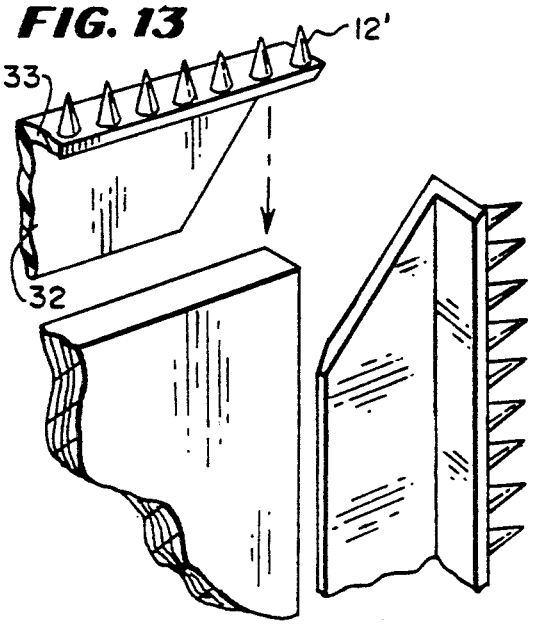
FIGS. 13–15 are partial exploded views of additional embodiments of the invention.
Figure 14:
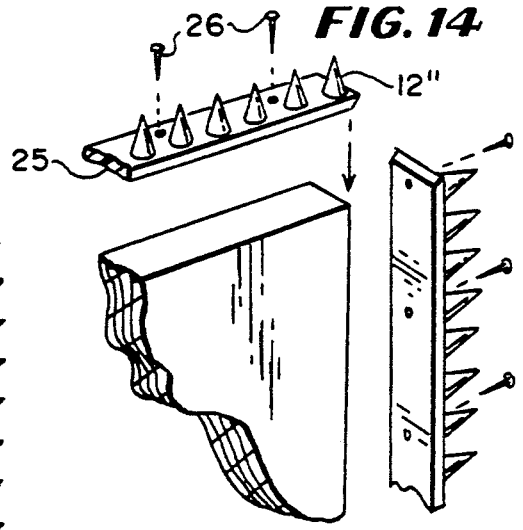

FIGS. 13–15 illustrate alternative embodiments of the invention. In FIG. 13, the barbs or teeth 12' are carried on an L-shaped molding having a back wall 32 and a side wall 33. The L-shaped molding is secured to the molding board by an adhesive, a double-sided tape as illustrated in FIGS. 7 and 8, or some other fastening means.

FIG. 14 illustrates yet another embodiment of the invention. In this embodiment, the barbs or teeth 12'' are carried on a flexible strip molding having only a side wall 25. This embodiment would be attached to the edge by small tacks 26 or staples, a strong adhesive or other fastening means. This embodiment is particularly well suited for attaching the barbs or teeth to the edge of a stretcher bar frame. Stretcher bar frames such as that manufactured by wolsey under the trade name "Stretcher Strips" are often used in the industry in place of a mounting board for needlepoint and other fabric art. An added advantage of the embodiment of FIG. 14 is that the barbed strip can be mounted either on the side edge or on the front or back periphery of the mounting board or stretcher frame.

FIG. 15 illustrates yet another embodiment of the invention. In this embodiment, the barbed molding 41 is attached to the front periphery of the mounting board. One or more rows of barbs or teeth 42 are provided to grasp the fabric as it is stretched over the board and impaled on the barbs 42. A side lip 43 which fits over the edge of the mounting board is provided which helps to align the barbed strip and also permits more gripping power as the natural recoil of the stretched fabric is opposed by the force of the lip 43 against the edge 45 of the board. One possible use for this embodiment is when the artist has not allowed a sufficient amount of fabric around the image to permit the use of the channel embodiment, FIG. 4. An overlay matting 46 could be used to hide from view the barbs piercing the fabric. The barbed strip 41 would also be small enough to fit into the rabbet of a conventional picture frame 50.

What is I claim is:

1. A device used for mounting fabrics on a structure having a substantially planar, nongrooved periphery, comprising: a strip having a pair of opposed sides, one of said pair of side proximate said structure; gripping means for gripping fabric, said gripping means extending outwardly from the other of said pair of sides of said strip; and means for attaching said strip to the periphery of said structure.

2. A device used for mounting fabric on a structure having a periphery, comprising: s strip having a pair of opposed sides, gripping means for gripping fabric, said gripping means including a plurality of cone-shaped teeth and extending outwardly from one of said pair of sides of said strip; and means for attaching said strip tot he periphery of said structure, wherein the other of said pair of sides is proximate said structure, and wherein fabric stretched over said structure is gripped by said gripping means.

3. A device as claimed in claim 1, wherein said means for gripping fabric includes a plurality of barbs.

4. A device used for mounting fabric on a mounting board having a periphery, edges and a pair of opposed faces, comprising: gripping means for gripping fabric, said fabric gripping means including a plurality of barbs; a generally L-shaped molding having an outside face, said fabric gripping means extending outwardly from a portion of said outside face of said L-shaped molding; means for attaching said molding to the periphery of said mounting board, the root of the L of said molding fitting over the edge of said mounting board wherein said gripping means is directed away from said mounting board, and wherein fabric stretched over one of said pair of faces of said mounting board is gripped by said gripping means.

5. A device used for mounting fabric on a mounting board having a periphery, edges and a pair of opposed faces, comprising: gripping means for gripping fabric; and a channel molding having an outside face, a front wall, a side wall, and a rear wall, said fabric gripping means extending outwardly from a portion of the outside face of said channel molding and including a plurality of barbs, said channel molding having a size sufficient to fit snugly about the edges of said mounting board so that fabric stretched over one of said pair of faces of said mounting board is gripped by said gripping means.

6. A device as claimed in claim 5, wherein said channel molding is formed of a resilient material.

7. A device as claimed in claim 5, wherein said rear wall is wider than said front wall.

8. A device as claimed in claim 5, wherein said gripping means is located on the outside face of said side wall opposite said front wall.

9. A device as claimed in claim 5, wherein said device is sufficiently small so as to fit inside a rabbet of a picture frame.

10. A device used for mounting fabric on a mounting board having a periphery, edges and a pair of opposed faces, comprising: gripping means for gripping fabric, a channel molding having an outside face, a front wall, a side wall, and a rear wall, and measuring means dimensioned for cutting predetermined lengths of said device, said gripping means extending outwardly from a portion of the outside face of said channel molding and including a plurality of barbs, said channel molding having a size sufficient to fit snugly about the edges of said mounting board so that fabric stretched over one of said pair of faces of said mounting board is gripped by said gripping means.

11. A device used for mounting fabric on a mounting board having a periphery, edges and a pair of opposed faces, comprising: a channel molding having an outside face, a front wall, a side wall, and a rear wall, a plurality of cone-shaped teeth extending outwardly from a portion of the outside face of said channel molding, said channel molding being formed of a resilient material and having a size sufficient so as to fit snugly about the edges of said mounting board so that fabric stretched over one of said pair of faces of said mounting board is gripped by said teeth, said device having a small enough size so as to fit inside a rabbet of a picture frame.

12. A method of mounting fabric on a mounting board having a periphery, comprising the steps of: attaching to the periphery of said mounting board a plurality of fabric gripping teeth; stretching a piece of fabric over one of said pair of faces of said board; gripping said fabric by said teeth; and fitting over said teeth a decorative picture frame molding.

13. A method for mounting fabric on a stretcher bar frame having a periphery, comprising the steps of: attaching tot he periphery of said frame a strip having a plurality of fabric gripping teeth extending outwardly from said strip and said frame; stretching said fabric over said frame; and gripping said fabric by said teeth.

14. A method for mounting fabric on a mounting board having a front periphery, a back periphery, an outside edge and a pair of opposed faces, comprising the steps of: taping the back periphery of said mounting board with double-sided tape; fitting on the outside edge of said mounting board and adhering to said double-sided tape, a channel molding having on a portion of an outside face a plurality of fabric gripping teeth; stretching a piece of fabric over one of said pair of faces of said board; gripping said fabric by said teeth; and fitting over said channel molding a decorative picture frame molding.

15. A kit for use in mounting fabric on a mounting board having a front periphery and a back periphery, said kit comprising, a channel molding having an outside edge and means for gripping fabric on the outside edge of said molding; double-sided tape for taping together the back periphery of said mounting board and said channel molding; and a decorative picture frame molding for fitting over said channel molding so as to hide from view said channel molding.

* * * * *